United States Patent [19]

Kolari et al.

[11] Patent Number: 4,967,625

[45] Date of Patent: Nov. 6, 1990

[54] ADJUSTABLE JAW SOCKET

[75] Inventors: James W. Kolari; Karen B Kolari, both of College Station, Tex.

[73] Assignees: James W. Kolari; Karen B. Kolari, both of College Station, Tex.

[21] Appl. No.: 401,808

[22] Filed: Sep. 1, 1989

[51] Int. Cl.[5] ..... B25B 13/16

[52] U.S. Cl. ..... 81/170; 81/165

[58] Field of Search ..... 81/155, 164, 165, 166, 81/170, 171, 185

[56] References Cited

U.S. PATENT DOCUMENTS

| | | | |
|---|---|---|---|
| 3,948,120 | 4/1976 | Hancock | 81/165 |
| 4,112,792 | 9/1978 | Guimarin | 81/63 |
| 4,277,991 | 7/1981 | Stuberauch | 81/170 |
| 4,436,004 | 3/1984 | Chang | 81/60 |
| 4,528,875 | 7/1985 | Hust et al. | 81/185 |
| 4,548,104 | 10/1985 | Hendricks | 81/170 |
| 4,706,528 | 11/1987 | Inoue | 81/179 |
| 4,793,225 | 12/1988 | Berkich | 81/356 |
| 4,794,824 | 1/1989 | Chapman | 81/168 |
| 4,798,108 | 1/1989 | Wilson | 81/170 |
| 4,809,570 | 3/1989 | Jeng | 81/185 |

*Primary Examiner*—Frederick R. Schmidt
*Assistant Examiner*—S. Keating Johns

[57] ABSTRACT

In one embodiment an adjustable jaw socket with a gripping facility is disclosed that is adapted for use with a socket wrench or other tool for providing rotary motion. The adjustable jaw socket includes a body with a stationary jaw and slotted members in its upper portion and an aperture for receiving the drive of ratchet wrench or other socket-type wrench in its lower portion, in addition to an adjustable jaw. Means are provided for securing the movable adjustable jaw at a selected position with respect to the body. Also, means responsive to rotary motion of an attached socket-type wrench to grip a nut or bolt for loosening and tightening operations is provided. In a second embodiment an improved adjustable jaw socket wrench includes a body with stationary jaw and slotted members in its upper portion and an aperture to engage the drive of a socket-type wrench in its lower portion, in addition to an adjustable jaw, wherein said slotted members are lower in height than the top surfaces of said stationary jaw and said adjustable jaw to enable usage in tight situations in which there is not adequate clearance on all sides of a nut or bolt to allow the socket to fit over the head of the nut or bolt. Means are provided for securing the adjustable jaw at a selected position relative to the body. Means also are provided for securing said slotted members describing the slotted opening in the upper portion of the body from widening under load in loosening and tightening operations.

7 Claims, 2 Drawing Sheets

ADJUSTABLE JAW SOCKET

BACKGROUND OF THE INVENTION

1. Field of the Invention

The invention relates generally to adjustable socket devices and, more particularly, to an adjustable socket device adapted for use with a ratchet or other socket-type wrench wherein means are provided for moving an adjustable jaw within the socket body to grasp a nut or other bolt-type fastener for tightening and loosening between the adjustable jaw and an opposing stationary jaw.

2. Description of the Prior Art

A number of adjustable sockets are described in the prior art. Typically, these prior devices have either one adjustable jaw and one stationary jaw or two or more adjustable jaws for varying the distance between the jaws. In all previous art for adjustable sockets, the jaws are adjusted to a position appropriate to fit the size of the nut or bolt, but there is no means for causing the jaws to provide a gripping facility as the wrench is rotated for loosening and tightening operations. The lack of a gripping capability can cause slippage in the case of rounded or worn nuts and bolts, as well as the potential inability to conduct loosening or tightening operations in this instance. Also, in the case of an adjustable end wrench using a worm adjustment which is adapted for use with a wrench handle, like crescent wrenches, a serious drawback is that loosening can occur in use which requires retightening to properly fit the bolt or nut size. This is a nuisance that would not be tolerable if used in conjunction with a long wrench handle in a hard-to-reach location. In U.S. Pat. No. 4,548,104 is described a locking element to keep the adjustable jaw of a wrench head at a fixed position to maintain the appropriate nut or bolt size. While prior art shows a gripping means for adjustable jaw wrenches, the gripping means is achieved only for adjustable end wrenches and adjustable vicegrip wrenches. Examples are shown in U.S. Pat. Nos. 4,793,225 and 4,794,824. In respect to this prior art, no gripping means adaptable to a socket wrench is provided. Moreover, the gripping devices shown in prior art do not achieve gripping action in the same way as the present invention.

Another shortfall of prior art that concerns adjustable jaw sockets is bulkiness. For example, U.S. Pat. No. 4,798,108 describes an adjustable socket-forming device that is adapted for use with a ratchet or other tool. It includes a body, a movable gripping member slidably mounted in the body, and a screw for securing the movable gripping member at a selected position with respect to the body. The body has a fixed gripping member with the approximate form of a hollow cylinder with a portion of one side of the cylindrical body removed to enable mounting of the movable gripping member. The generally cylindrical shape of this device prevents its use in tight locations where there is no room to accommodate this cylindrical socket shape.

SUMMARY OF THE INVENTION

It is the first object of the present invention to provide an adjustable jaw socket device with jaws that grip a nut or bolt as an attached wrench handle is rotated for loosening or tightening operations. This gripping capability is not found in prior art for adjustable jaw socket wrenches. Also, no prior art for wrenches in general achieves gripping in the same way as the present invention. The present invention represents an advancement over prior art in number of respects. First, the present invention enables the user to use an adjustable socket wrench to tighten and loosen rounded or worn nuts and bolts. Second, the gripping facility of the adjustable socket wrench reduces slippage that could cause injury to the user. Third, the gripping facility of the adjustable socket wrench enables the user to use less force in tightening and loosening operations.

The adjustable jaw socket of the present invention includes the combination of a body, movable adjustable jaw slidably mounted by the body, a means for moving the adjustable jaw to a selected position with respect to the body, and a means for providing gripping action on a nut or bolt as it is loosened or tightened. The body includes an upper portion with two opposing stationary jaw members and a slotted opening located at the base of the stationary jaw members and running from one stationary jaw member to the other, in addition to a lower portion with an aperture to engage a drive of a ratchet wrench or other wrench with a drive for use with wrench sockets. Each of the two stationary jaw members has one jaw face that opposes the jaw face of the other stationary jaw member, wherein these jaw faces are shaped to grasp a nut or bolt. The adjustable jaw includes an upper portion with a jaw member and a lower portion with a sleeve that slidably fits in the slotted opening of the upper portion of the body. The jaw member of the adjustable jaw has two jaw faces that are located back-to-back with respect to one another, wherein these jaw faces are each shaped to grasp a nut or bolt. The adjustable jaw is slidably mounted by the body such that one stationary jaw face and one adjustable jaw face oppose one another and the second stationary jaw face and second adjustable jaw face also oppose one another. Moreover, the adjustable jaw is movable with respect to the body to enable movement of the adjustable jaw to a selected position to fit a nut or bolt.

In a further aspect of the invention, the means for securing the adjustable jaw member is a screw connected to both the body and the adjustable jaw. The adjustable jaw includes an internally threaded opening in its lower portion, and the screw includes a shaft that is threadedly engaged with the adjustable jaw and slidably mounted in the body. Rotation of the screw causes the adjustable jaw to move with respect to the body and, therefore, vary the distance between the adjustable jaw and the stationary jaw members.

In a further aspect of the invention, the means for providing gripping action of the adjustable jaw in conjunction with one of the two opposing stationary jaw comprises a gear head on the screw that is meshed with a gear surface of a bushing that slidably fits the circumference of the lower portion of the body. The screw is slidably mounted in the body with the gear head located outside the outer surface of the body and with an attaching retainer located on the other end of the screw outside the outer surface of the body on the other side of the body. The bushing is slidably secured to the body by abutting its smooth bottom perimeter against a protruding portion of the base of the lower portion of the body and by meshing its gear surface on its top perimeter with the gear head of the screw mounted in the body. After the adjustable jaw is moved to fit a nut or bolt between the jaw face of one of the stationary jaw members and one of the jaw faces of the jaw member of the adjustable jaw, rotary motion of a wrench with driver engaged with the aperture in the lower portion of the body causes a gripping action between the adjustable jaw and whichever of the two stationary jaw members is being used. One of the stationary jaw members in combination with the adjustable jaw is used for tightening operations, while the other stationary jaw member in combination with the adjustable jaw is used for loosening operations.

The first object of the present invention is relatively simple in construction, is easy to manually use, provides for continuous adjustments for fitting many different sizes of fasteners (as opposed to a specific size of fastener or set of specific sizes of fasteners), is useable with conventional socket wrenches that have a drive to engage sockets with corresponding apertures to receive said drive, complements the use of a set of sockets of fixed sizes, and, unlike prior art, provides a means for gripping nuts or bolts for the purpose of tightening or loosening.

It is the second object of the present invention to provide an improved adjustable jaw socket which combines the advantages of both an adjustable jaw socket wrench and an adjustable jaw wrench. Examples of the latter are either a crescent wrench or combination of a wrench head having a stationary jaw and a sliding jaw and a wrench handle with mating projection received in a square hole in the wrench head. The advantage of an adjustable jaw socket wrench over an adjustable jaw wrench is that the former has the ability to perform tasks in which the head of the nut or bolt does not protrude out of the main body of the workpiece. An example of an adjustable jaw socket wrench is U.S. Pat. No. 4,798,108. On the other hand, the advantage of an adjustable jaw wrench over an adjustable jaw socket wrench is that the former can be used in tight situations in which there is not adequate clearance on all sides of the nut or bolt to allow the socket to fit over the head of the nut or bolt. The reason for this is that the adjustable jaw wrench has an open end between its jaws, while the adjustable jaw socket wrench shown in prior art is cylindrical in shape and has no open end. In the present invention an improved adjustable jaw socket wrench is provided wherein there is an opening between the stationary jaw and the adjustable jaw.

Briefly, the present invention contemplates the provision of an improved adjustable jaw socket comprised of a body, an adjustable jaw, means for securing the adjustable jaw at a selected position with respect to the body, and means for securing the body members holding the adjustable jaw in the body from widening under load in loosening and tightening operations. The body has an upper portion with both a stationary jaw member protruding upward from one side of the body and slotted members describing a slotted opening at the base of the stationary jaw member extending away from the stationary jaw member, in addition to a lower portion with an aperture for attaching the drive of a wrench handle. The adjustable jaw is mounted by the body in the slotted members describing the slotted opening. The adjustable jaw opposes the protruding stationary jaw member, which leaves an opening between these jaws. Means are provided for securing the slotted members in the upper portion of the body from widening under load during loosening and tightening operations. This reduces the bulkiness of the jaw members and enables the use of the present invention in tight situations in which prior art would not be useable.

These and other features of the invention will become apparent in the detailed description and claims to follow, taken in conjunction with the accompanying drawings.

BRIEF DESCRIPTION OF THE INVENTION

DETAILED DESCRIPTION OF THE INVENTION

Figure 7:
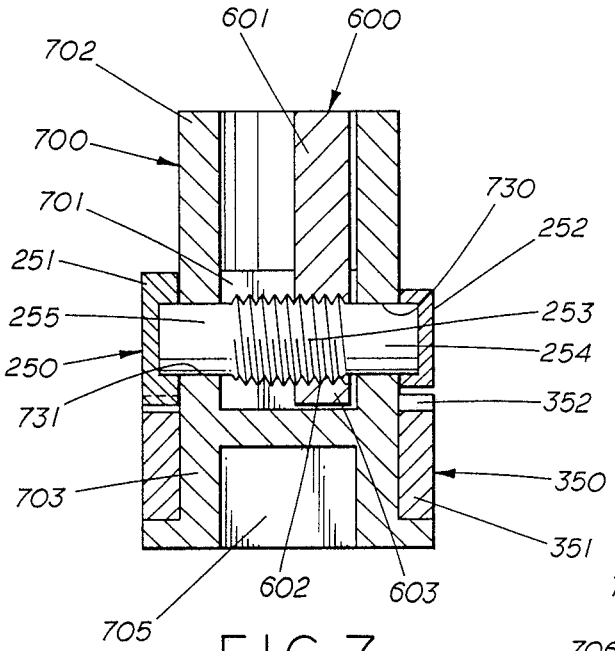
FIG. 7 is a cross sectional view of an adjustable jaw socket according to the first embodiment of the present invention.
Figure 8:
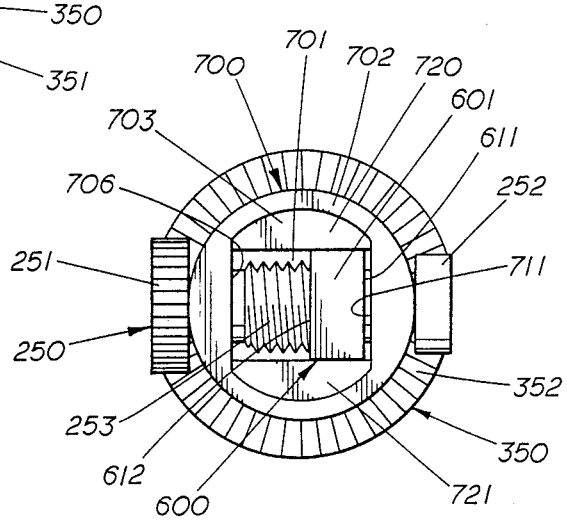
FIG. 8 is a top plan view of the device in FIG. 11.
Figure 9:
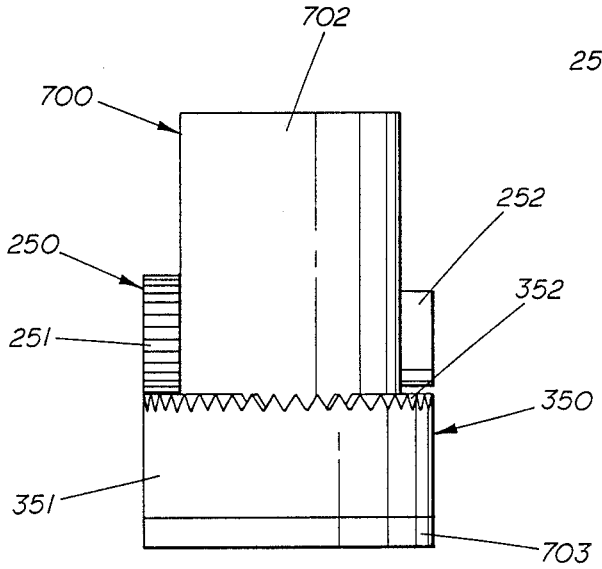
FIG. 9 is side elevational view of the device in FIG. 11.

FIGS. 7, 8, and 9 show a first embodiment of the adjustable jaw socket of the present invention that includes means for gripping the head of a nut or bolt as rotary motion of an attached wrench is applied for loosening or tightening operations. The device generally comprises cylindrical body 700, adjustable jaw 600 mounted in body 700, screw 250 threadedly connected to adjustable jaw 600 and secured in body 700, and bushing member 350 with gear surface 352 on its top perimeter meshed with gear head 251 of screw 250. Bushing member 350 is slidably mounted on the outside of body 700. Bushing member 350 has a smooth lower perimeter that abuts protruding portion 703 of body 700 at its base. Bushing member 350 is retained on body 700 between protruding base 703 and gear head 251 of screw 250.

Body 700 generally comprises an upper portion 702 with cylindrical shape having inner planar stationary jaw faces 706 and 711 (FIG. 8) located opposite one another and having inner sleeve members 720 and 721 which describe slotted opening 701, in addition to lower portion 703 with opening 705 adapted for connecting the present invention to a source of rotary motion, such as a drive or lug of a socket wrench. Slotted opening 701 is made to accommodate adjustable jaw 600. In lower portion 703 of body 700 are holes 730 and 731 in body 700 for mounting screw 250 in a horizontal position relative to body 700.

Adjustable jaw 600 is comprised of jaw member 601 in its upper portion with jaw faces 611 and 612 on opposite sides of jaw member 601, and a lower portion with internally threaded hole 602 to threadedly engage screw 250.

Screw 250 is comprised of gear head 251, threaded portion 253, smooth shank portions 254 and 255 to slidably fit in holes 730 and 731 of body 700, and attaching retainer 252. Attaching retainer 252 secures screw 250 in body 700 in a manner enabling rotational meshing of gear head 251 of screw 250 with gear surface 352 of bushing member 350.

In the embodiment illustrated in FIGS. 7, 8, and 9, adjustable jaw 600 is moved to a selected position by manually rotating bushing member 350 with gear face 352 on its top surface operably meshed with gear head 251 of screw 250, causing screw 250 to turn and, therefore, adjustable jaw 600 to move horizontally along the length of the threaded portion of screw 250 mounted in body 700. Alternatively, circular casing 351 of bushing member 350 is manually held fixed in one place, and the wrench handle, engaged by means of a drive to aperture 705 of body 700, is rotated.

Once the correct position of adjustable jaw 600 is obtained to fit a nut or bolt, gripping of the nut or bolt for tightening or loosening operations is achieved by rotation of the wrench handle with drive engaged with aperture 705 of body 700.

To tighten a nut or bolt stationary jaw face 706 and adjustable jaw face 612 (FIG. 8) are used. After adjusting these two jaw faces to fit a nut or bolt size, according to the threads shown on threaded portion 253 of screw 250 (FIG. 8), body 700 is rotated counter-clockwise as viewed from the top by rotary motion of an attached wrench handle in this same direction. This turns gear head 251 clockwise as viewed from the side, which imparts a clockwise rotation on screw 250. Consequently, adjustable jaw 600 is urged to move toward stationary jaw face 706 of body 700 (FIG. 8) and, in turn, gear head 251 is pinned against the outside surface of body 700. If the gear head is not pinned by the rotary motion of the wrench handle, bushing member 350 can be manually grasped and its rotation resisted as the wrench handle is turned. Once gear head 251 is pinned against body 700, further rotation of the wrench handle causes a gripping action on the nut or bolt. To tighten the nut or bolt body 700 is turned in a counter-clockwise direction as viewed from the top as desired. If the rotation of bushing member 350 is resisted by manually grasping bushing member 350 as the wrench handle is rotated for tightening operations, the clamping or gripping action on the nut or bolt of stationary jaw face 706 and adjustable jaw face 612 is increased. Once tightening operations are completed, to release the gripping action of stationary jaw face 706 and adjustable jaw face 612, outer casing 351 of bushing member 350 is manually turned in a clockwise direction.

To loosen a nut or bolt stationary jaw face 711 and adjustable jaw face 611 (FIG. 8) are used. Operations involving the adjustment of the position of adjustable jaw 600, gripping the nut or bolt, and loosening the nut or bolt are like those used for tightening discussed above but reversed. After adjusting these jaw faces 711 and 611 to fit a nut or bolt size, the wrench handle is turned clockwise from the top (FIG. 8). This causes gear head 251 to rotate clockwise as viewed from the side and impart a counter-clockwise rotation to screw 250. Thus, adjustable jaw 600 is urged to move toward stationary jaw face 711 and, in turn, attaching retainer 252 is pinned against the outside surface of body 700. If attaching retainer 252 is not pinned by the rotation of the wrench handle, bushing member 350 can be manually grasped and its rotation resisted as the wrench handle is turned. Once attaching retainer 252 is pinned on the outside surface of body 700, further rotation of the wrench handle provides a gripping action on the nut or bolt between adjustable jaw face 611 and stationary jaw face 711. The nut or bolt is loosened by rotating body 700 in a clockwise direction as desired. If the rotation of bushing member 350 is resisted by manually grasping bushing member 350 as the wrench handle is rotated for loosening operations, the clamping or gripping action on the nut or bolt of stationary jaw face 711 and adjustable jaw face 611 is increased. To disengage the gripping action of stationary jaw face 711 and adjustable jaw face 611, outer casing 351 of bushing member 350 is manually rotated in a counterclockwise direction.

Although the jaw faces in the above description of the present invention are flat, it is conceivable that other shapes for the jaw faces may be used to grasp a nut or bolt. For example, each jaw face, which includes both stationary jaw faces and both adjustable jaw faces, could be made as two planar surfaces inclined at a 60 degree angle with respect to one another so as to define two adjacent surfaces of a hexagonal socket.

Figure 1:
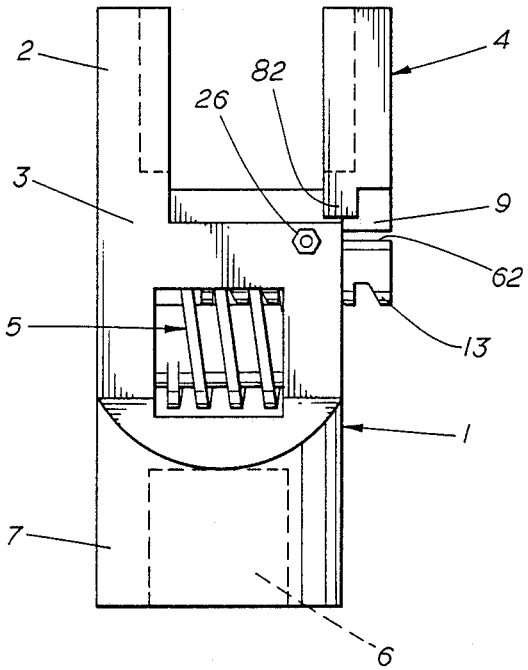
FIG. 1 is a side elevational view of the adjustable jaw socket of the second embodiment of the present invention that reveals an opening between the stationary jaw member of the body and the adjustable jaw.
Figure 2:
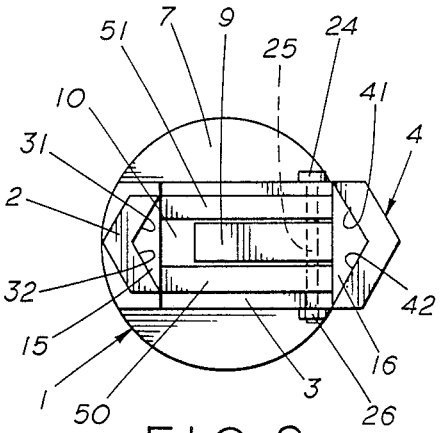
FIG. 2 is a top plan view of the adjustable jaw socket shown in FIG. 1 that reveals a slotted opening in the upper portion of the body defined by slotted members of said body, said slotted members fixedly secured on one end of said slotted opening by a screw and nut to prevent said slotted members from widening under load.
Figure 3:
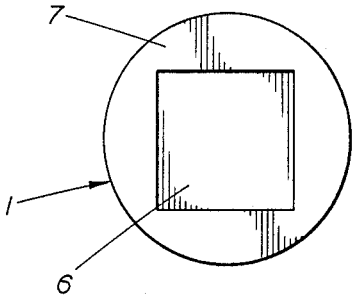
FIG. 3 is a bottom plan view of the adjustable jaw socket of FIG. 1 that reveals an aperture in the lower portion of the body.
Figure 4:
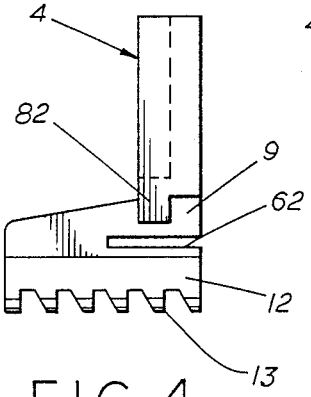
FIG. 4 is a side elevational view of the adjustable jaw socket shown in FIGS. 1 and 2.

FIGS. 1, 2, 3, 4, 5, and 6 show a second embodiment of the adjustable jaw socket of the present invention in which an improved adjustable jaw socket wrench with an opening between the stationary jaw and the adjustable jaw is provided. As shown in FIG. 1, the improved adjustable jaw socket of the present invention comprises body 1, with upper portion 3 and lower portion 7, adjustable jaw 4, and worm gear 5. Upper portion 3 has stationary jaw 2 and slotted opening 10 defined by slotted members 50 and 51 (FIG. 2). Lower portion 7 includes aperture 6 to engage a drive of a ratchet wrench or other socket-type wrench (FIG. 3). Adjustable jaw 4 slidably fits in and is movable along said slotted opening 10 of body 1. Worm gear 5 is rotably journaled on body 1 about a spindle 14 (FIG. 6) at a location intermediate to upper portion 3 and lower portion 7 of body 1. Worm gear 5 engages rack teeth 13 of adjustable jaw 4 to adjust the spacing between stationary jaw 2 and adjustable jaw 4 for different size nuts or bolts.

FIG. 2 shows a top view of the present invention. Slotted members 50 and 51 describe slotted opening 10 in which adjustable jaw 4 slidably moves forward and backward relative to stationary jaw 2 of body 1 to provide an infinitely variable size adjustment for nuts or bolts. The narrow construction of slotted members 50 and 51 and opening between the two jaws enables the use of the present invention in tight spaces in which prior art adjustable jaw socket wrenches would not be useable. Also, because adjustable jaw 4 and stationary jaw 2 of body 1 protrude upwards, the present invention can be used in situations where the nut or bolt does not protrude out of the main body of the workpiece. Jaw surfaces 31 and 32 form two obliquely angled planes that describe a spread V shape for stationary jaw 2 of body 1. Likewise, jaw surfaces 41 and 42 form two obliquely angled planes that describe a spread V shape for adjustable jaw 4. At the base of jaw surfaces 31 and 32 is securing member 15, and at the base of jaw surfaces 41 and 42 is securing member 16. These securing members strengthen the jaw surfaces to prevent their bending under load. Sleeve 9 of adjustable jaw 4 slidably fits slotted opening 10 in upper portion 3 of body 1.

Figure 5:
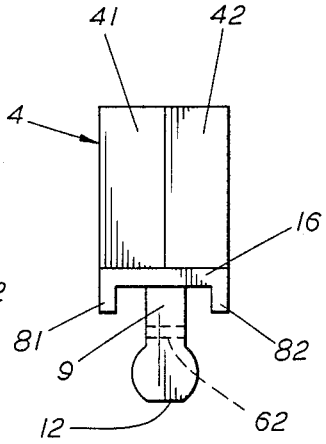
FIG. 5 is a front elevational view of the adjustable jaw in FIG. 4 that reveals downward projecting wings on the bottom, outer edges of the adjustable jaw faces that serve to prevent said slotted members of said body from widening under load.
Figure 6:
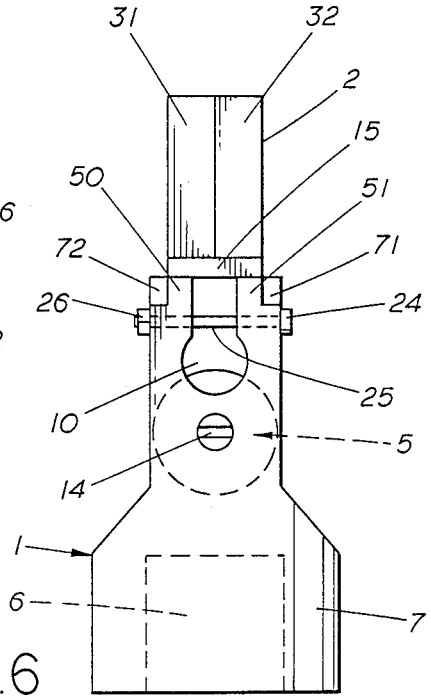
FIG. 6 is a front elevational view of the adjustable jaw socket in FIG. 1 wherein the adjustable jaw is omitted to expose the interior jaw faces of said fixed jaw.

An important aspect of the improved adjustable jaw socket wrench of the present invention is the means for securing slotted members 50 and 51 of body 1 from widening under load. In this regard, FIG. 2 shows screw 25 that is slidably mounted in slotted members 50 and 51 at a location perpendicular to the length of slotted opening 10 and at the end of slotted opening 10 opposite stationary jaw 2 of body 1. Head 24 of screw 25 is located on the outside surface of slotted member 51, while nut 26 is threadedly attached to screw 25 so as to provide a snug fit against the outside surface of slotted member 50 (see also FIG. 6). Slotted members 50 and 51, therefore, are locked in a fixed position between nut 26 and head 24 of screw 25, respectively, so as not to widen under load during loosening or tightening of a nut or bolt. To further strengthen slotted members 50 and 51 from widening under load, as shown in FIG. 5, adjustable jaw 4 has two wings labeled 81 and 82 projecting downward from the bottom, outside corners of jaw surfaces 41 and 42. As shown in FIG. 6, in which the adjustable jaw has been removed, lowered edges 71 and 72 of the top, outside surface of slotted members 50 and 51 are made to slidably accommodate wings 81 and 82, as indicated in FIG. 1.

In addition to retaining slotted members 50 and 51 from widening under load, screw 25 serves the additional function of retaining adjustable jaw 4 in slotted opening 10 of body 1. With screw 25 securely fastened to slotted members 50 and 51 by nut 26, adjustable jaw 4 can not be removed from slotted opening 10 in body 1. In respect to horizontal movement of adjustable jaw 4, slotted opening 62 in sleeve 9 of adjustable jaw 4 (FIGS. 1 and 4) enables wider adjustment of the space between stationary jaw 2 and adjustable jaw 4 than otherwise, such that the present invention can be used on larger size nuts or bolts than otherwise.

The embodiments described and shown to illustrate the present invention have necessarily been specific for purposes of illustration. Alterations, extensions and modifications would be apparent to those skilled in the art. The aims of the appended claims, therefore, are to cover all variations included within the spirit and scope of the invention.

The embodiments of the invention in which an exclusive property or privilege is claimed are defined as follows:

1. An adjustable jaw socket, comprising:

body means, said body means including integral upper and lower portions, said lower portion having an aperture to receive a drive of a ratchet wrench or other socket-type wrench, said upper portion having two stationary jaw members protruding upward and positioned opposite one another, wherein one of said stationary jaw members has a jaw face that is used for tightening operations and the second of said stationary jaws has a jaw face that is used for loosening operations, in addition to slotted members that describe a slotted opening;

an adjustable jaw slidably mounted in said body means comprising an upper portion with an adjustable jaw member and a lower portion with a sleeve, said adjustable jaw member having two jaw faces on opposite sides of said adjustable jaw member, wherein one of said jaw faces is used for tightening operations and the second of said jaw faces is used for loosening operations, said sleeve including means for mounting said adjustable jaw between said two stationary jaw faces for sliding movement in said slotted opening of said upper portion of said body means;

means for securing said adjustable jaw at a selected position with respect to said body means, to thereby form a socket of a selected size between said adjustable jaw and said stationary jaw members of said upper portion of said body means; and means responsive to rotary motion of a socket wrench drive handle attached in said aperture in said lower portion of said body means to urge said adjustable jaw against a nut or bolt located between said adjustable jaw and one of the two stationary jaws, to thereby provide gripping action on a nut or bolt for loosening or tightening operations.

2. The adjustable jaw socket in claim 1, wherein each of said two stationary jaw members has a jaw face that is shaped so as to form a planar surface, and wherein each of said two jaw faces of said adjustable jaw member also is shaped so as to form a planar surface.

3. The adjustable jaw socket in claim 1, wherein each of said two stationary jaw members has a jaw face that is shaped so as to form a spread V shape and, wherein each of said two jaw faces of said adjustable jaw member also is shaped so as to form a spread V shape.

4. The adjustable jaw socket of claim 1, wherein said means for securing said adjustable jaw at a selected position with respect to said body means comprises a screw horizontally mounted in said body means between said upper portion and said lower portion, said screw being threadedly connected to said adjustable jaw, said adjustable jaw having an internally threaded hole.

5. The adjustable jaw socket of claim 4, wherein said means responsive to rotary motion of a socket wrench drive handle attached in said aperture in said lower portion of said body means to provide a gripping action of said adjustable jaw on a nut or bolt located between said adjustable jaw and one of the two stationary jaws comprises said screw having a gear head on one end and an attaching retainer on the other end in addition to a bushing member with a gear face on its top perimeter that is operably engaged with said gear head of said screw, said bushing member with diameter to provide sliding fit on outer surface of said lower portion of said body means, said bushing member manually operable to cause movement of said adjustable jaw relative to said two stationary jaws to both select a position to fit a nut or bolt and enable the nut or bolt to be gripped in loosening and tightening operations.

6. An improved adjustable jaw socket comprising:

an adjustable jaw socket wrench including a body means with integral upper portion and lower portion, said lower portion having an aperture to receive a drive of a ratchet wrench or other socket-type wrench, said upper portion having a stationary jaw with jaw surfaces that form two obliquely angled planes in a spread V shape to fit a fastener in addition to slotted members that describe a slotted opening in said upper portion, an adjustable jaw reciprocally mounted in said body means comprising an upper portion and a lower portion, said upper portion defined by jaw surfaces that form two obliquely angled planes in a spread V shape and that oppose said jaw surfaces of said stationary jaw to fit a fastener between said stationary jaw and said adjustable jaw, said lower portion having a sleeve made to slidably fit in said slotted opening in said upper portion of said body means, means for securing said adjustable jaw at a selected position with respect to said stationary jaw, such as a screw or worm gear, and means for securing said slotted members in said upper portion of said body means to thereby prevent said slotted members from widening under load in loosening and tightening operations, wherein the improvement comprises:

said body means with slotted members that are lower in height than the top surfaces of said stationary jaw and said adjustable jaw to enable tightening or loosening operations in tight situations in which there is not adequate clearance on all sides of a nut or bolt to allow the socket to fit over the head of the nut or bolt;

said means for securing said slotted members in said upper portion of said body means from widening under load comprising a screw mounted in said slotted members, such that said screw is perpendicular to said slotted opening at a position near the end of said slotted opening opposite the location of said stationary jaw, said screw secured to said slotted members by a head on one end and a nut fastened on the other end, said head of said screw abutting the outside surface of one slotted member, said nut fastened on the other end of said screw abutting the outside surface of the other slotted member, in addition to wing portions of said adjustable jaw, said wing portions extending downward from both bottom, outside corners of said jaw surfaces, said wing portions extending downward on the outside of said slotted members when said adjustable jaw is mounted in said body means, said wing portions slidably fitting the top, outside surfaces of said slotted members.

7. The improved adjustable jaw socket of claim 6, wherein said sleeve portion of said adjustable jaw has a horizontal slot in its rear surface to slidably fit the shank of said screw.

* * * * *